US012716421B2

(12) United States Patent
Jacques et al.

(10) Patent No.: US 12,716,421 B2
(45) Date of Patent: Aug. 25, 2026

(54) PORTABLE FAN

(71) Applicant: MILWAUKEE ELECTRIC TOOL CORPORATION, Brookfield, WI (US)

(72) Inventors: Vann R. Jacques, Mequon, WI (US); Gregory A. Mutchler, Milwaukee, WI (US); Yong Dong Huang, Shaoguan City (CN); Jian Jun Wang, Zhanjiang City (CN); Zu Gen Ni, Suzhou City (CN)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 29 days.

(21) Appl. No.: 18/693,827

(22) PCT Filed: Sep. 21, 2022

(86) PCT No.: PCT/US2022/044202
§ 371 (c)(1),
(2) Date: Mar. 20, 2024

(87) PCT Pub. No.: WO2023/055624
PCT Pub. Date: Apr. 6, 2023

(65) Prior Publication Data

US 2024/0392796 A1 Nov. 28, 2024

(30) Foreign Application Priority Data

Sep. 30, 2021 (CN) ..... 202122406540.8

(51) Int. Cl.
*F04D 29/053* (2006.01)
*F04D 25/06* (2006.01)
(Continued)

(52) U.S. Cl.
CPC ..... *F04D 29/053* (2013.01); *F04D 25/0673* (2013.01); *F04D 25/08* (2013.01);
(Continued)

(58) Field of Classification Search
CPC .. F04D 29/053; F04D 29/054; F04D 29/0673; F04D 29/20; F04D 29/263;
(Continued)

(56) References Cited

U.S. PATENT DOCUMENTS 3,697,198 A * 10/1972 Holder, Jr. ..... A47J 37/0754 126/25 B
4,245,957 A * 1/1981 Savage ..... F04D 29/263 416/214 R
(Continued)

FOREIGN PATENT DOCUMENTS

CN 214247763 U 9/2021
JP H0921399 A 1/1997
(Continued)

OTHER PUBLICATIONS

International Search Report and Written Opinion for Application No. PCT/US2022/0442002 dated Jan. 12, 2023 (10 pages).

*Primary Examiner* — Kenneth J Hansen
(74) *Attorney, Agent, or Firm* — Michael Best & Friedrich LLP

(57) ABSTRACT

A fan and a motor assembly. The motor assembly includes an electric motor with an output shaft defining a rotational axis, an impeller coupled to the output shaft for co-rotation therewith, an adapter positioned between the output shaft and the impeller, and an elastic member positioned between the adapter and the impeller. The elastic member is configured to be compressed by the impeller in response to installation of the impeller upon the adapter, from an undeformed state to an elastically deformed state, in which the elastic member is compressed in a direction of the rotational axis.

20 Claims, 4 Drawing Sheets

(51) Int. Cl.
*F04D 25/08* (2006.01)
*F04D 29/26* (2006.01)
*F04D 29/32* (2006.01)

(52) U.S. Cl.
CPC ..... *F04D 29/263* (2013.01); *F04D 29/325* (2013.01); *F04D 29/329* (2013.01)

(58) Field of Classification Search
CPC .... F04D 29/266; F04D 29/329; F04D 29/668; F05D 2260/38
USPC ..... 416/204 R; 464/37, 89, 180
See application file for complete search history.

(56) References Cited

U.S. PATENT DOCUMENTS 8,292,591 B2 * 10/2012 Leso ..... F04D 29/181 416/204 R
D674,888 S 1/2013 Kawase et al.
D686,309 S 7/2013 Kokawa et al.
D689,183 S 9/2013 Chan
D887,542 S 6/2020 Youngblutt
D893,698 S 8/2020 Lin
D919,075 S 5/2021 Lin
D962,514 S 8/2022 Mei
D964,543 S 9/2022 Mo
D967,391 S 10/2022 Lin
2006/0147259 A1 * 7/2006 Hu ..... F16D 1/096 403/343
2019/0003480 A1 1/2019 Hall et al.

FOREIGN PATENT DOCUMENTS

JP 3272117 B2 4/2002
JP 2014015851 A 1/2014
JP 2020101153 A 7/2020

* cited by examiner

PORTABLE FAN

CROSS-REFERENCE TO RELATED APPLICATIONS

This application is a national stage filing under 35 U.S.C. § 371 of International Application No. PCT/US2022/044202 filed Sep. 21, 2022, which claims foreign priority to Chinese Utility Model application No. 202122406540.8 filed Sep. 30, 2021, now Chinese Patent No. ZL202122406540.8, the entire contents of all of which are incorporated herein by reference.

TECHNICAL FIELD

The present disclosure relates to fans, and more particularly to portable fans.

BACKGROUND

Fans are often used for drying and cooling on a variety of jobsites. Portable fans generally include a battery operable to power the fan so that the fan may be transported to a variety of locations without needing a power outlet. Fans typically include a motor powered by the battery and an impeller coupled to the motor for rotation therewith. Occasionally, vibrational noise will be produced between the motor and the impeller that is undesirable.

SUMMARY OF THE DISCLOSURE

The present disclosure provides, in one aspect, a motor assembly including an electric motor with an output shaft defining a rotational axis, an impeller coupled to the output shaft for co-rotation therewith, an adapter positioned between the output shaft and the impeller, and an elastic member positioned between the adapter and the impeller. The elastic member is configured to be compressed by the impeller in response to installation of the impeller upon the adapter, from an undeformed state to an elastically deformed state, in which the elastic member is compressed in a direction of the rotational axis.

Optionally, the elastic member is an O-ring.

Optionally, the adapter is radially positioned between the output shaft and the impeller.

Optionally, the adapter includes a first end, an opposite second end, and a bore through the second end in which the output shaft is received.

Optionally, the bore only extends partially through the adapter.

Optionally, the adapter includes a first end, an opposite second end, and a radially outward extending flange proximate the second end.

Optionally, the impeller includes a central hub, and the elastic member is axially positioned between the central hub and the radially outward extending flange.

Optionally, the motor assembly further comprises a retaining ring positioned between the adapter and the central hub, the retaining ring is configured to maintain the elastic member in the elastically deformed state.

Optionally, the adapter includes a circumferential groove proximate the first end in which the retaining ring is received.

Optionally, the adapter includes a non-circular exterior surface, and the impeller includes an opening having a corresponding non-circular interior surface mated with the non-circular exterior surface of the adapter.

The present disclosure provides, in another aspect, a motor assembly including an electric motor with an output shaft defining a rotational axis, an impeller with a central hub coupled to the output shaft for co-rotation therewith, and an adapter radially positioned between the output shaft and the central hub. The adapter includes a first end, an opposite second end, and a radially outward extending flange proximate the second end and facing the motor. The motor assembly also includes an elastic member positioned between the radially outward extending flange and the central hub. The elastic member is configured to be compressed between the central hub and the radially outward extending flange in response to installation of the impeller upon the adapter, from an undeformed state to an elastically deformed state, in which the elastic member is compressed in a direction of the rotational axis.

Optionally, the adapter includes a bore through the second end in which the output shaft is received.

Optionally, the motor assembly further comprises a retaining ring positioned between the adapter and the central hub, the retaining ring is configured to maintain the elastic member in the elastically deformed state.

Optionally, the adapter includes a circumferential groove proximate the first end in which the retaining ring is received.

Optionally, the adapter includes a non-circular exterior surface, and the central hub includes an opening having a corresponding non-circular interior surface mated with the non-circular exterior surface of the adapter.

The present disclosure provides, in yet another aspect, a fan includes a housing, a battery receptacle that is configured to receive a battery pack, and an electric motor within the housing and configured to receive electrical current from the battery pack when the motor is activated. The motor includes an output shaft defining a rotational axis. The fan also includes an impeller coupled to the output shaft for co-rotation therewith, an adapter positioned between the output shaft and the impeller, and an elastic member positioned between the impeller and the adapter. The elastic member is configured to be compressed by the impeller in response to installation of the impeller upon the adapter, from an undeformed state to an elastically deformed state, in which the elastic member is compressed in a direction of the rotational axis.

Optionally, the elastic member is an O-ring.

Optionally, the adapter is radially positioned between the output shaft and the impeller.

Optionally, the adapter includes a first end, an opposite second end, and a bore through the second end in which the output shaft is received.

Optionally, the bore only extends partially through the adapter.

Optionally, the adapter includes a first end, an opposite second end, and a radially outward extending flange proximate the second end.

Optionally, the impeller includes a central hub, and the elastic member is axially positioned between the central hub and the radially outward extending flange.

Optionally, the fan further comprises a retaining ring positioned between the adapter and the central hub, the retaining ring is configured to maintain the elastic member in the elastically deformed state.

Optionally, the adapter includes a circumferential groove proximate the first end in which the retaining ring is received.

Optionally, the adapter includes a non-circular exterior surface, and the impeller includes an opening having a corresponding non-circular interior surface mated with the non-circular exterior surface of the adapter.

Other features and aspects of the disclosure will become apparent by consideration of the following detailed description and accompanying drawings. Any feature(s) described herein in relation to one aspect or embodiment may be combined with any other feature(s) described herein in relation to any other aspect or embodiment as appropriate and applicable. For example, in some aspects, there is provided a fan including the motor assembly of any one of the aspects.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting.

Figure 1:
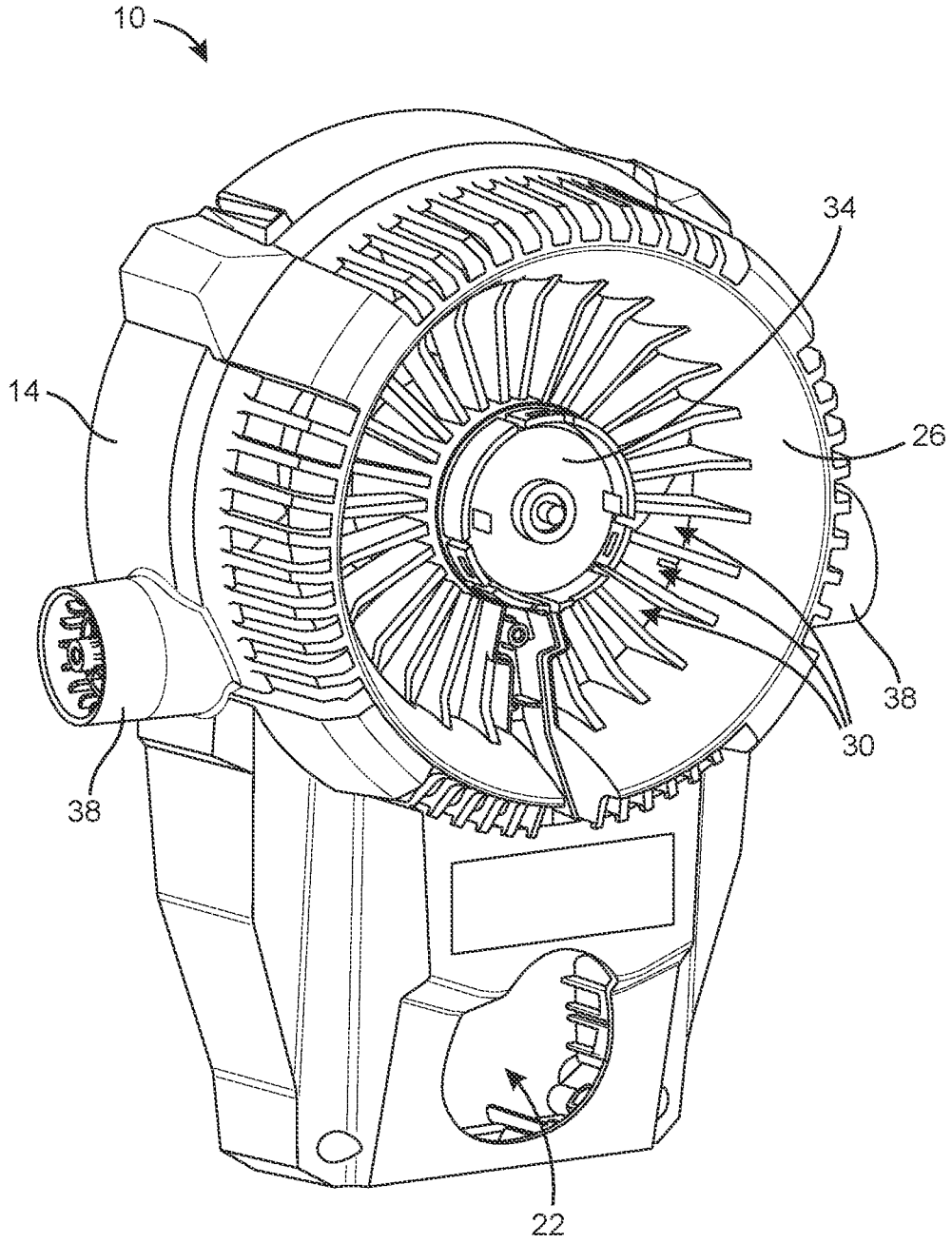
FIG. 1 is a perspective view of a portable fan in one embodiment of the disclosure.

FIG. 1 illustrates a portable fan 10 according to one embodiment of the disclosure. The portable fan 10 includes a housing 14 and a motor assembly 18 (FIG. 2) disposed within the housing 14. The housing 14 defines a battery receptacle 22 configured to receive a battery pack (not shown). The housing 14 includes a grill portion 26 that defines a plurality of vents 30 that extend into the interior of the housing 14. A motor hub 34 is positioned in the center of the grill portion 26 and supports the motor assembly 18 within the interior of the housing 14. The housing 14 also includes support arms 38 that a stand may be coupled to support the housing 14 above a surface. Although not shown, the housing 14 may support a control panel that includes user input features that control operation of the portable fan 10. For example, the housing 14 may support an ON/OFF switch, a power control dial, or other control features.

Figure 2:
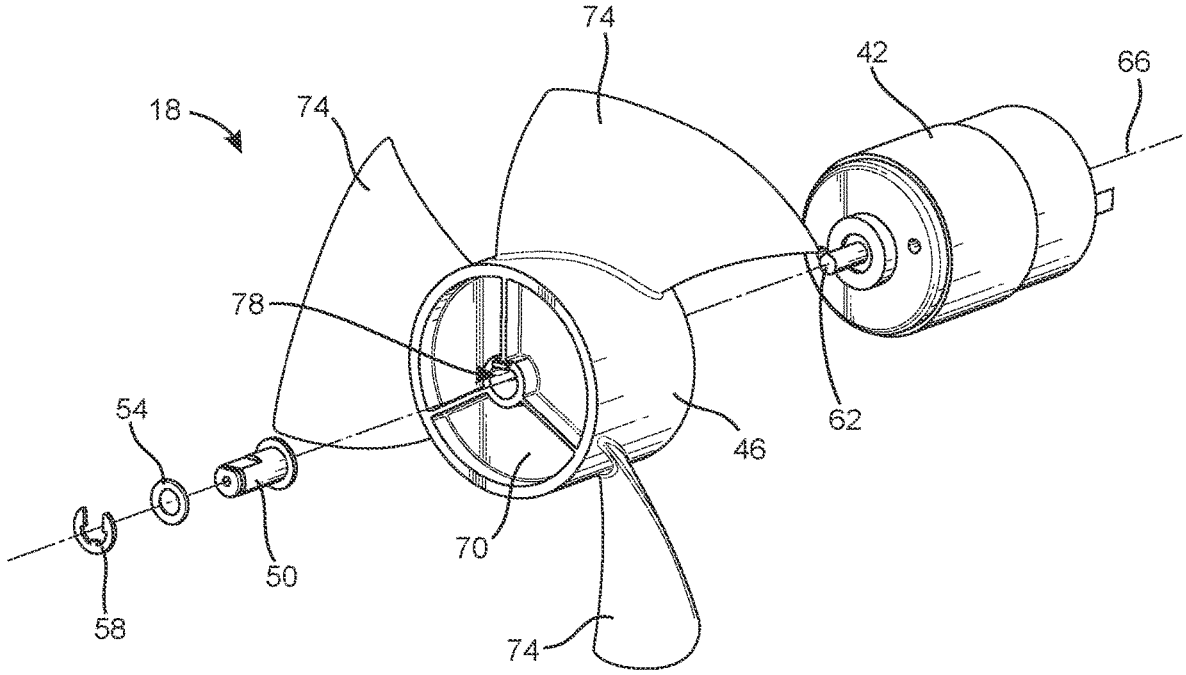
FIG. 2 is an exploded view of a motor assembly of the portable fan of FIG. 1.

With reference to FIG. 2, the motor assembly 18 includes a motor 42, an impeller 46, an adapter 50, an elastic member 54, and a retaining ring 58. The motor 42 is configured as a DC motor that receives power from an on-board power source (e.g., a battery, not shown). The battery may include any of a number of different nominal voltages (e.g., 12V, 18V, etc.), and may be configured having any of a number of different chemistries (e.g., lithium-ion, nickel-cadmium, etc.). In some embodiments, the battery is a battery pack removably coupled to the housing 14. Alternatively, the motor 42 may be powered by a remote power source (e.g., a household electrical outlet) through a power cord. The motor 42 includes an output shaft 62 defining a rotational axis 66 of the motor assembly 18.

Figure 4:
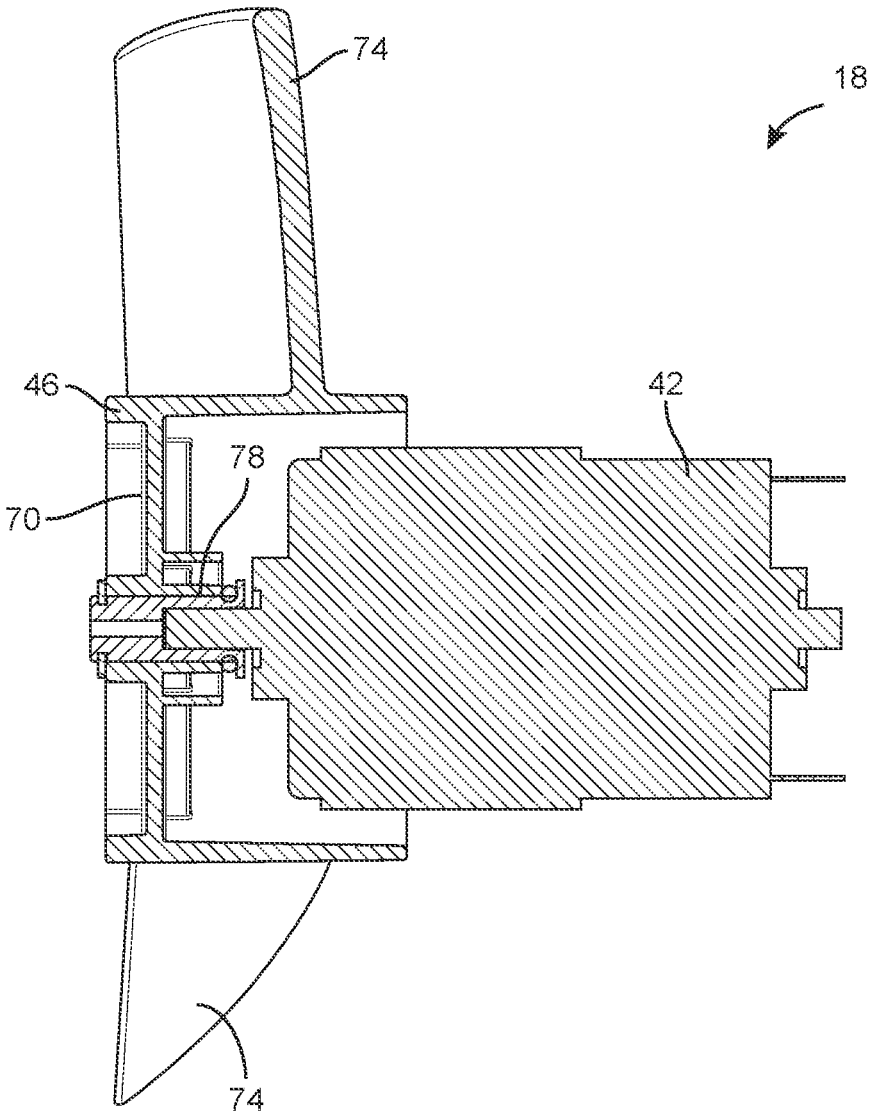
FIG. 4 is a cross-sectional view of the motor assembly of FIG. 2.

Referring to FIGS. 2 and 4, the impeller 46 includes a central hub 70 and a plurality of vanes 74 extending from the central hub 70. An opening 78 extends through the central hub 70 of the impeller 46. Moving to FIG. 5, the opening 78 includes a first portion with a generally circular interior surface 82 and a second portion with a non-circular interior surface 86. The central hub 70 also includes a positioning tab 90 (FIG. 5) extending from one side of the impeller 46. The impeller 46 is coupled to the output shaft 62 of the motor 42 for co-rotation therewith as will be described in more detail below.

Figure 3:
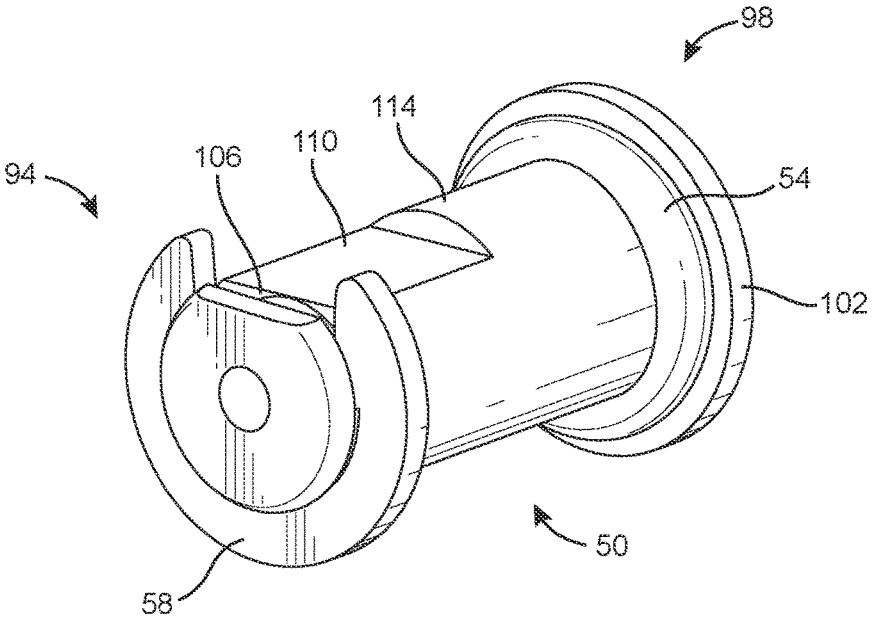
FIG. 3 is a perspective view of the motor assembly of FIG. 2 with components removed.

With reference to FIG. 3, the adapter 50 includes a first end 94, a second end 98 opposite the first end 94, and a radially outward extending flange 102 proximate the second end 98 and in a facing relationship with the motor 42. The adapter 50 also includes a circumferential groove 106 proximate the first end 94 that receives the retaining ring 58 when the motor assembly 18 is assembled. The adapter 50 further includes a non-circular exterior surface 110 proximate the first end 94 and a circular exterior surface 114 between the non-circular exterior surface 110 and the flange 102. A bore 118 (FIG. 5) extends into the second end 98 of the adapter 50. The bore 118 only extends partially into the second end 98 of the adapter 50. The bore 118 is configured to receive the output shaft 62 of the motor 42 when the motor assembly 18 is assembled. In some embodiments, the bore 118 may extend through the adapter 50 between the first and second ends 94, 98. In the illustrated embodiment, the adapter 50 is positioned radially between the output shaft 62 of the motor 42 and the impeller 46. In other words, the adapter 50 is positioned between the output shaft 62 of the motor 42 and the impeller 46 in a direction that is perpendicular to the rotational axis 66.

Figure 5:
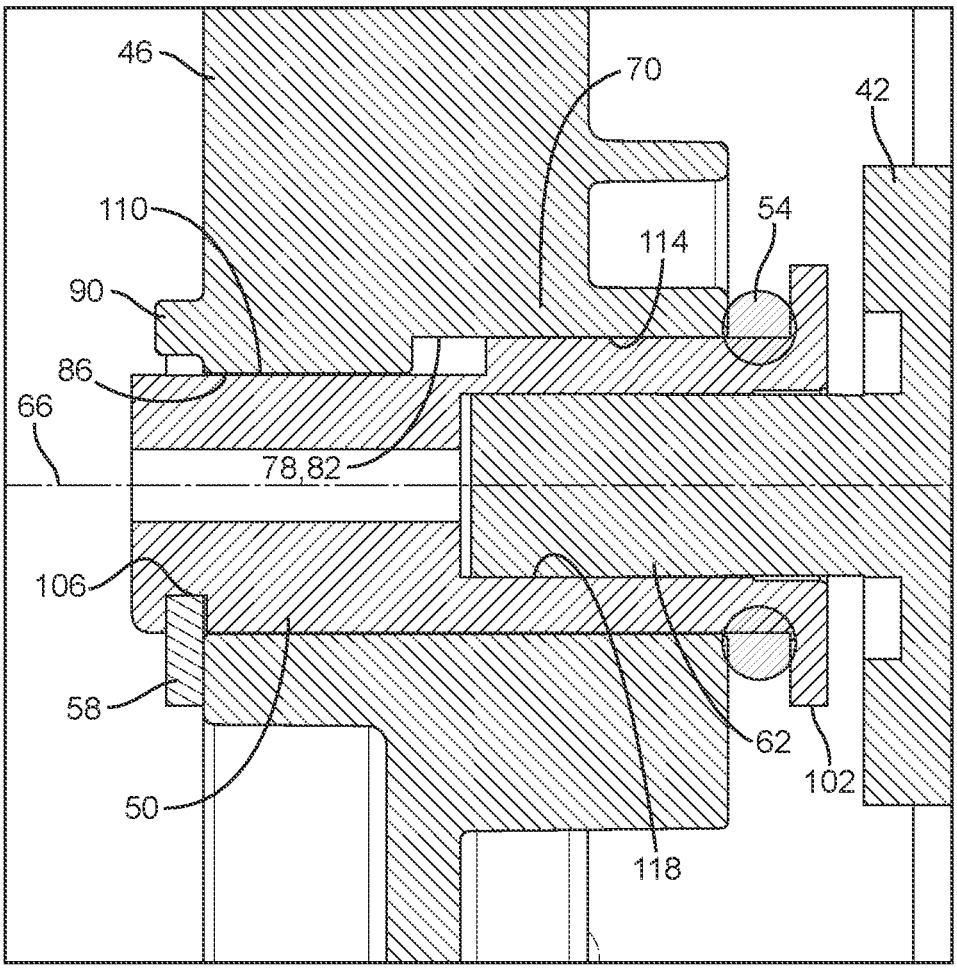
FIG. 5 is a close-up view of a portion of the motor assembly of FIG. 4.

As shown in FIG. 5, the elastic member 54 is positioned between the adapter 50 and the impeller 46 when the motor assembly 18 is assembled. Specifically, the clastic member 54 is axially positioned between the central hub 70 of the impeller 46 and the flange 102 of the adapter 50. The elastic member 54 is compressed by the impeller 46 in response to the impeller 46 being installed upon the adapter 50. When the impeller 46 is installed, the elastic member 54 is compressed from an undeformed state to an elastically deformed state, in which the elastic member 54 is compressed in a direction of the rotational axis 66. In the illustrated embodiment, the elastic member 54 is an O-ring. In other embodiments, the elastic member 54 may be other resilient members such as a spring or gaskets.

With continued reference to FIG. 5 the impeller 46 is positioned on the adapter 50 with the non-circular exterior surface 110 of the adapter 50 mating with the non-circular interior surface 86 of the opening 78 and the circular exterior surface 114 of the adapter 50 mating with the circular interior surface 82 of the opening 78. The mating of the non-circular exterior surface 110 and the non-circular interior surface 86 further secures the impeller 46 on the adapter 50. Specifically, the mating of the non-circular exterior surface 110 and the non-circular interior surface 86 inhibits relative rotation about the rotational axis 66 between the impeller 46 and the adapter 50.

With the impeller 46 installed on the adapter 50, the retaining ring 58 is positioned in the circumferential groove 106 of the adapter 50. The positioning tab 90 of the impeller 46 aligns with an opening of the retaining ring 58 to secure the retaining ring 58 on the adapter 50. The retaining ring 58 maintains the elastic member 54 in the elastically deformed state with a minimum amount of axial compression to prevent axial movement of the impeller 46 relative to the adapter 50 and the motor output shaft 62. In other words, the elastic member 54 is elastically deformed when the impeller 46 is installed on the adapter 50, but not compressed to the point where the elastic member 54 becomes essentially rigid with no remaining elasticity. As such, the elastic member 54 is positioned between the adapter 50 and the impeller 46 in a compressed state but not a completely compressed state. In the illustrated embodiment, the elastic member 54 is compressed in a direction parallel to the rotational axis 66 a maximum of 0.35 mm and at a minimum of 0.1 mm when positioned between the impeller 46 and the adapter 50. In other embodiments, the elastic member 54 may be compressed more than 0.35 mm or less than 0.1 mm based on the total diameter of the elastic member 54.

Providing the elastic member 54 axially between the flange 102 of the adapter 50 and the impeller 46 inhibits the impeller 46 from sliding axially, which prevents unwanted vibrations and noise. In addition, maintaining the elastic member 54 in the elastically deformed state with a minimum amount of axial compression prevents a gap from forming between the adapter 50 and the impeller 46, which as mentioned, inhibits axial movement of the impeller 46, but also maintains a non-rigid connection because the clastic member 54 is not being fully compressed. In other words, the elastic member 54 being minimally compressed by the retaining ring 58 allows for the elastic member 54 to compress further if needed without becoming fully rigid, while still inhibiting a gap between the adapter 50 and the impeller 46. If the elastic member 54 were to become fully compressed, the elastic member 54 would act as a rigid component. If the elastic member 54 were to act as a rigid component, the motor 42 would translate too much vibration energy into the impeller 46 and undesirable vibrations and noise would be produced.

During operation of the portable fan 10, power from a power source is provided to the motor 42 to energize the motor 42. Energizing the motor 42 rotates the output shaft 62 about the rotational axis 66. Rotation of the output shaft 62 rotates the adapter 50 and thus the impeller 46 about the rotational axis 66. The vanes 74 of the impeller 46 induce an airflow that is expelled through the vents 30 in the grill portion 26 of the housing 14. Due to the elastic member 54 being deformed a minimum amount between the adapter 50 and the impeller 46, the impeller 46 is inhibited from sliding axially along the adapter 50, preventing unwanted vibration and noise. In addition, since the elastic member 54 is not fully compressed between the adapter 50 and the impeller 46, the motor 42 does not translate vibrational energy to the impeller 46, preventing unwanted vibrations and noise. As such, operation of the portable fan 10 is generally quieter compared to other portable fans.

Various features and advantages are set forth in the claims.

The invention claimed is:

1. A motor assembly comprising:

an electric motor including an output shaft defining a rotational axis;

an impeller having a central hub coupled to the output shaft for co-rotation therewith, the central hub having an opening extending from a first end of the central hub to a second end of the central hub;

an adapter positioned between the output shaft and the impeller, the adapter having a first end, a second end, and a radially outward extending flange at the second end of the adapter; and an elastic member axially positioned between the radially outward extending flange of the adapter and the central hub of the impeller, the elastic member configured to be compressed by the impeller in response to installation of the impeller upon the adapter, from an undeformed state to an elastically deformed state, in which the elastic member is compressed in a direction of the rotational axis, wherein when the impeller is installed upon the adapter, the first end of the adapter is adjacent the first end of the central hub and the second end of the adapter is adjacent the second end of the central hub.

2. The motor assembly of claim 1, wherein the elastic member is an O-ring.

3. The motor assembly of claim 1, wherein the adapter is radially positioned between the output shaft and the impeller.

4. The motor assembly of claim 1, wherein the adapter includes a bore through the second end of the adapter in which the output shaft is received.

5. The motor assembly of claim 4, wherein the bore only extends partially through the adapter.

6. The motor assembly of claim 1, further comprising a retaining ring positioned between the adapter and the central hub, wherein the retaining ring is configured to maintain the elastic member in the elastically deformed state.

7. The motor assembly of claim 6, wherein the adapter includes a circumferential groove proximate the first end of the adapter in which the retaining ring is received.

8. The motor assembly of claim 1, wherein the adapter includes a non-circular exterior surface, and wherein the impeller includes an opening having a corresponding non-circular interior surface mated with the non-circular exterior surface of the adapter.

9. A motor assembly comprising:

an electric motor including an output shaft defining a rotational axis;

an impeller including a central hub coupled to the output shaft for co-rotation therewith;

an adapter radially positioned between the output shaft and the central hub, the adapter including a first end, an opposite second end, and a radially outward extending flange proximate the second end and facing the electric motor; and an elastic member positioned between the radially outward extending flange and the central hub, the elastic member configured to be compressed between the central hub and the radially outward extending flange in response to installation of the impeller upon the adapter, from an undeformed state to an elastically deformed state, in which the elastic member is compressed in a direction of the rotational axis, wherein the adapter includes a non-circular exterior surface, and wherein the central hub includes an opening having a corresponding non-circular interior surface mated with the non-circular exterior surface of the adapter.

10. The motor assembly of claim 9, wherein the adapter includes a bore through the second end in which the output shaft is received.

11. The motor assembly of claim 9, further comprising a retaining ring positioned between the adapter and the central hub, wherein the retaining ring is configured to maintain the elastic member in the elastically deformed state.

12. The motor assembly of claim 11, wherein the adapter includes a circumferential groove proximate the first end in which the retaining ring is received.

13. A fan comprising:

a housing;

a battery receptacle configured to receive a battery pack;

an electric motor within the housing and configured to receive electrical current from the battery pack when the electric motor is activated, the electric motor including an output shaft defining a rotational axis;

an impeller coupled to the output shaft for co-rotation therewith;

an adapter positioned between the output shaft and the impeller; and an elastic member positioned between the impeller and the adapter, the elastic member configured to be compressed by the impeller in response to installation of the impeller upon the adapter, from an undeformed state to an elastically deformed state, in which the elastic member is compressed in a direction of the rotational axis, wherein the adapter includes a first end, an opposite second end, and a bore through the second end in which the output shaft is received, and wherein the bore only extends partially through the adapter.

14. The fan of claim 13, wherein the elastic member is an O-ring.

15. The fan of claim 13, wherein the adapter is radially positioned between the output shaft and the impeller.

16. The fan of claim 13, wherein the adapter includes a radially outward extending flange proximate the second end.

17. The fan of claim 16, wherein the impeller includes a central hub, and wherein the elastic member is axially positioned between the central hub and the radially outward extending flange.

18. The fan of claim 17, further comprising a retaining ring positioned between the adapter and the central hub, wherein the retaining ring is configured to maintain the elastic member in the elastically deformed state.

19. The fan of claim 18, wherein the adapter includes a circumferential groove proximate the first end in which the retaining ring is received.

20. The fan of claim 13, wherein the adapter includes a non-circular exterior surface, and wherein the impeller includes an opening having a corresponding non-circular interior surface mated with the non-circular exterior surface of the adapter.

* * * * *